United States Patent [19]

Langenhorst

[11] 4,251,962

[45] Feb. 24, 1981

[54] CLAMPING DEVICE FOR CLAMPING A STRUCTURE INTO A FRAME

[75] Inventor: Günter Langenhorst, Bad Sassendorf, Fed. Rep. of Germany

[73] Assignee: top-element-Bauelemente für Innenausbau & Raumgestaltung GmbH & Co. KG, Fed. Rep. of Germany

[21] Appl. No.: 25,084

[22] Filed: Mar. 29, 1979

[30] Foreign Application Priority Data

Apr. 8, 1978 [DE] Fed. Rep. of Germany ..... 2815296

[51] Int. Cl.[3] ..... E06B 1/12

[52] U.S. Cl. ..... 52/127; 49/504; 52/211; 52/213; 403/374

[58] Field of Search ..... 403/104, 363, 373, 374; 52/208, 211, 212, 213, 215, 217, 766, 767, 768, 127, 346; 49/504, 505

[56] References Cited

U.S. PATENT DOCUMENTS

| | | | |
|---|---|---|---|
| Re. 29,965 | 4/1979 | Zinn | 52/346 X |
| 661,620 | 11/1900 | Rumbarger | 403/373 X |
| 1,821,182 | 9/1931 | Hoppes | 403/374 |
| 3,553,891 | 1/1971 | Casebolt et al. | 49/505 |

FOREIGN PATENT DOCUMENTS

| | | | |
|---|---|---|---|
| 7317354 | 6/1975 | Netherlands | 49/505 |

*Primary Examiner*—Alfred C. Perham

*Attorney, Agent, or Firm*—McGlew and Tuttle

[57] ABSTRACT

A clamping device for clamping a structure, such as a door or window case, into a frame of substantially U-shape cross-section, and which has an inner web wall with an offset portion and a sidewall on each side, comprises, a clamping body of substantially U-shape cross-section. The clamping body has a back web wall adapted to be secured to the structure and a leg wall on each side of the web wall which extends outwardly therefrom. At least a portion of the length of each of the leg walls is resilient so that it may be bent inwardly or outwardly. The substantially U-shaped abutment has a back abutment wall which is adapted to be slidably engaged into a receiving groove at the offset portion of the frame. It includes an abutment sidewall on each side which is disposed alongside the respective ones of the leg walls. A clamp member is movably disposed between the side leg walls of the clamping body and it is displaceable to move these walls into clamping engagement with the sidewall of the abutment. This clamping interengagement is effected by a set screw which is threaded through the offset portion of the frame and through both the side leg walls of the clamping body and the abutment sidewalls and into the clamp member so that rotation of the set screw effects shifting of the clamp member to cause the movement of the side leg walls into engagement with the abutment walls and effect the clamping of the structure in the frame.

4 Claims, 4 Drawing Figures

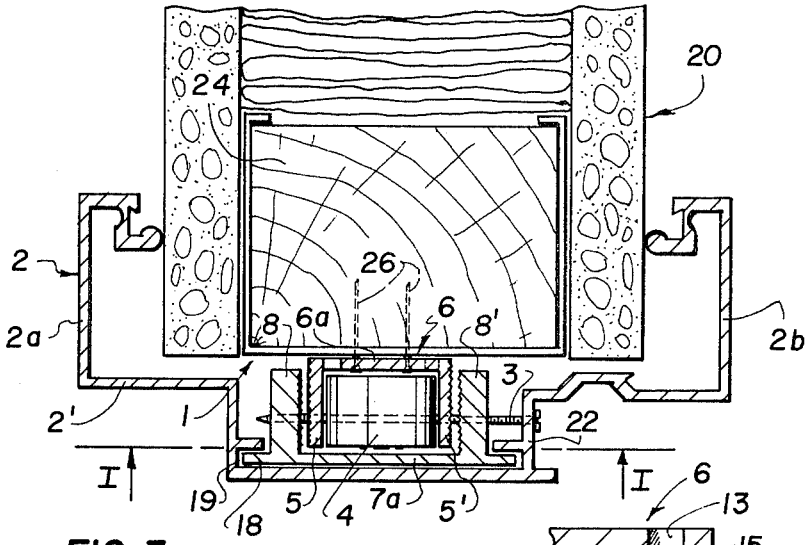
FIG. 3
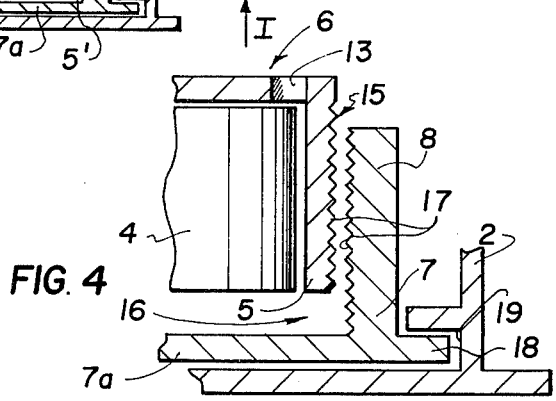
FIG. 4
FIG. 1
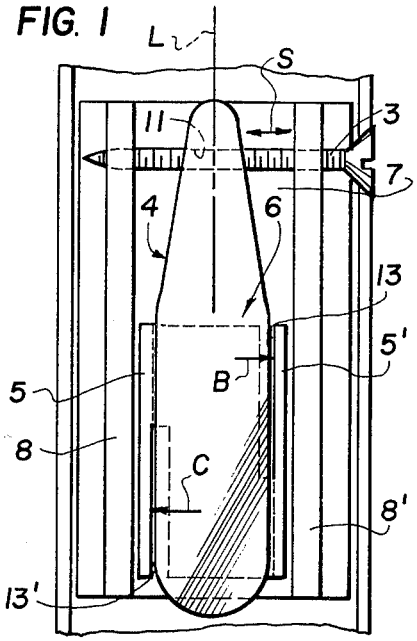
FIG. 2
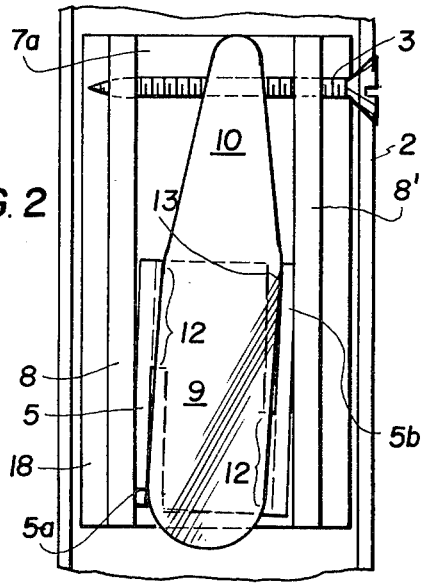

CLAMPING DEVICE FOR CLAMPING A STRUCTURE INTO A FRAME

FIELD AND BACKGROUND OF THE INVENTION

This invention relates to devices for securing objects in frames in general and, in particular, to a new and useful clamping device for clamping a structure, such as a door or window case, into a frame.

DESCRIPTION OF THE PRIOR ART

An adjusting device for aligning frames in frame apertures is known which comprises an adjusting wedge which is displaceable perpendicularly to the plane of the frame and includes a propping element which cooperates in such a manner that one part is pressed to the soffit of the frame aperture and the other part is pressed to the inside of the frame which is assembled of channel sections. In this known adjusting device, the adjusting wedge is applied by its sliding surface directly to the backside of the web of the frame and the means for displacing the adjusting wedge is a set screw which is actuable from the outside of the frame and penetrates one leg of the frame.

The propping element is disposed between the adjusting wedge and the soffit of the frame aperture and comprises a resilient portion which is disposed on the frame in such a manner that the propping element is pressed against the tightening surface of the adjusting wedge. This adjusting device has proven satisfactory, but it only serves the purpose of aligning frames in frame apertures, and does not wedge aligned frames in the respective frame apertures. (See German Pat. No. 2,447,731).

SUMMARY OF THE INVENTION

The present invention is directed to a clamping device ensuring an immovable wedging of frames which have already been aligned in frame apertures, particularly of aligned door or window cases in wall apertures, while compensating for dimensional tolerances in concealed constructions.

In accordance with the invention, the clamping between a structure such as a door frame or a window case into a U-shaped frame is effected by securing a clamping body to the structure and by effecting clamping engagement of the clamping body to an abutment which is adapted to be secured to the frame. This is effected by a wedge member which is disposed between sidewalls of the clamping body and which may be shifted so as to cause the sidewalls to move outwardly into engagement with the sidewalls of the abutment and become clamped thereto. The shifting is effected by a clamping member in the form of a wedge which is tilted about an angle perpendicular to its longitudinal axis so as to displace the sidewalls of the clamping body which are made resilient into clamping engagement with the sidewalls of the abutment.

The result of these inventive measures is that a clamping effect can be produced between the sidewalls or so-called U-legs of the clamping body secured to the soffit or lintel of the frame aperture and the U-legs of the abutment which is secured to the inside of the frame, by moving the clamping wedge by means of a set screw which is actuable from the outside of the frame. That is, due to the tilting motion produced by means of the set screw, the clamping wedge first applies against one U-leg and then against the other U-leg of the clamping body and, finally, forces the U-legs apart in a diagonal direction and against the U-legs of the abutment. As a result, a quite satisfactory clamping seat is obtained.

The independent position of the U-legs of the clamping body and of the abutment makes it possible to displace them in depth during the alignment of the respective frame. Since the entire clamping device is disposed between the soffit of the frame aperture and the frame, it remains invisible except for the screw head projecting laterally from the frame.

In practice, a plurality of inventive clamping devices spaced by predetermined distances may be distributed in the zones below the soffit or lintel of the frame aperture and the clamping bodies and abutments corresponding to each other may be easily aligned during their securing in the frame aperture or on the frame by means of template-like assembly rails, etc. Basically, the inventive clamping device can be used both at the left-hand side and the righthand side. Due to its simple design, it may be manufactured easily of rod stock.

Further features substantial to the invention are set forth in the following. Thus, the invention teaches that the clamping wedge comprises an even portion extending between the U-legs of the clamping body and a tapering portion extending outside the clamping body and penetrated by the set screw, so that the diagonal position of the clamping wedge on the opposite U-legs of the clamping body during the actuation of the set screw can be reached particularly rapidly. In accordance with the invention, the wedge portion penetrated by the set screw is provided with a tapped hole for the set screw so that the rotary motion of the set screw is transformed into a reciprocating tilting motion of the clamping wedge in a particularly simple way.

The U-legs of the clamping body are preferably separated from the web of the clamping body by longitudinal slots, except for a connecting portion of predetermined length, so that the U-legs are elastic in bending. The clamping surfaces associated with each other of the U-legs of the clamping body and the abutment may comprise matching profile patters, for example, corrugations, serrations or the like, to obtain a particularly intimate locking.

The abutment advantageously comprises laterally projecting flanges so that it can be inserted or clamped in corresponding grooves of the frame. In order to prevent damage to the surface of the respective frame, it is possible to connect the abutment by bonding with the frame on the inside thereof, for example, by welding or cementing. The clamping body may be secured to the soffit or lintel by screwing or doweling. The clamping body is preferably made of metal or of a resilient plastic. The same applies to the abutment.

The substantial advantage of the invention is that it provides a clamping device which ensures a completely satisfactory wedging of the already aligned frame in frame apertures, particularly of door or window cases in wall apertures, in a concealed, and thus in practice, invisible arrangement, and, at the same time, compensates for dimensional tolerances.

In order to wedge the frame or case, only the set screw which is accessible on the side of the frame is to be actuated. A connection, free of any possibility of misalignment of the frame in the frame aperture, more particularly, of the case in the wall aperture for the door or window is obtained apparently without damaging the surface of the frame or case. The distinctive features of the inventive clamping device are that it is simple in design and reliable in operation.

Accordingly, an object of the present invention is to provide a clamping device for clamping a structure, such as a door or window case into a frame of substantially U-shape cross-section which has an inner web wall with an offset portion and a sidewall on each side and which comprises a clamping body of substantially U-shaped cross-section having a back web wall adapted to be secured to the structure and a leg wall on each side of the web wall which exends outwardly therefrom and including a substantially U-shaped abutment which has a back abutment wall which is adapted to be engaged in the offset portion of the frame and a sidewall on each side of the back abutment wall which is disposed alongside the leg walls and which further includes a clamp member movably disposed within the clamping body and which is connected to a set screw so that, upon rotation of the set screw, the clamp member engages the side leg walls of the body and moves them into clamping abutment with the abutment sidewalls.

A further object of the present invention is to provide a clamping device for clamping a structure into a frame which is simple in design, rugged in construction, reliable in operation and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 1 is a section taken on the line I-I of FIG. 3 of a clamping device for clamping a structure in a frame, constructed in accordance with the present invention;

FIG. 2 is a view similar to FIG. 1, showing the clamping device in the clamped position;

FIG. 3 is a horizontal sectional view of a doorframe having a clamping structure therein for securing the door frame in the frame in accordance with the invention; and FIG. 4 is an enlarged partial sectional view, similar to FIG. 3.

DESCRIPTION OF THE PREFERRED EMBODIMENT

Referring to the drawings in particular, the invention embodied therein, comprises, a clamping device for clamping a structure, such as a door or window case, generally designated 20, into a frame, generally designated 2, which is of substantially U-shaped cross-section. Frame 2 has an inner web wall 2' with an offset portion 22 and a sidewall **2*a* and 2*b* on respective sides of the inner web wall 2'**.

In accordance with the invention, the clamping device includes a clamping body 6 of substantially U-shaped cross-section having a back web wall **6*a* which is adapted to be secured to the structure 20, such as to a soffit portion 24 thereof by means of securing screws 26**.

The clamping body has a back web wall **6*a* through which the screws 26 are directed, and it has a leg wall 5, 5' on respective sides of the web wall which extend outwardly from the web wall. At least a portion 5*a* and 5*b* of the length of each leg wall 5 and 5', respectively, is made resilient, for example, by slotting the back web wall 6*a* as at 13 and 13'**.

A substantially U-shape abutment has a back abutment wall **7*a* which is adapted to be engaged in the offset portion 22 of the frame 2 and it has an abutment sidewall 8 and 8' on respective sides which are disposed alongside respective ones of said leg walls 5 and 5'**.

In accordance with the invention, a clamp member is movably disposed between the side leg walls 5 and 5' and it is displaceable so as to move these resilient portions of these leg walls into engagement with the abutment sidewalls 8 and 8', respectively. For this purpose, set screw means in the form of a set screw 3 is threaded into the offset portion of the frame 2 through at least one of the sidewalls of the abutment and the clamp member and into the wedge. Rotation of the screw 3 effects the displacement of the wedge toward and away from the longitudinal axis L thereof.

The drawings show a clamping device for wedging aligned frames in frame apertures 1, particularly, in aligned door or window cases in wall apertures. This clamping device comprises a set screw 3 penetrating the respective frame 2, and a wedge which extends perpendicularly to the plane of the frame and is provided on the inside of the frame. Set screw 3 is actuable from the outside of the frame or of the U-legs of frame 2. The wedge is designed as a clamping wedge 4 and is penetrated by set screw 3 perpendicularly to its longitudinal axis L.

Clamping wedge 4 is mounted on set screw 3 for shifting motion, within a predetermined clearance S, between resilient sidewalls 5 and 5' of the clamping body 6 to be secured to a soffit or lintel 7 in the frame aperture 1. Clamping body 6 along with clamping wedge 4 arranged between the sidedwalls 5 and 5' thereof is embraced by the U-shaped abutment 7 to be secured to the inside of the frame 2, and includes sidewalls 8 and 8' disposed opposite to and spaced from sidewalls 5 and 5'.

Clamping wedge 4 comprises a uniformly dimensioned portion 9 extending between the walls 5 and 5' of clamping body 6, and a tapering portion 10 extending outside the clamping body 6 and penetrated by the set screw 3. The portion 10 penetrated by the screw 3 is provided with a tapped hole 11 for set screw 3. Except for a connecting portion 12 of predetermined length, the sidewalls 5 and 5' of clamping body 6 are separated from a web portion 14 of the clamping body 6 by a longitudinal slot 13 and, consequently, the sidewalls behave as leaf springs.

Clamping surfaces defined by roughened or knurled faces 15 and 16 are defined on each of the sidewalls 5, 5' and 8, 8' of the clamping body 6 and the abutment 7. The surfaces 15 and 16 are provided with a profile pattern 17, for example, with corrugations. Abutment 7 comprises laterally projecting flanges 18 and can therefore be inserted or clamped into corresponding grooves 19 of the frame 2. At least clamping body 6 is made either of a metal or a resilient plastic.

While mounting a frame structure into the frame aperture 1, first clamping bodies 6 are screwed or dowelled in predetermined positions in the zone of the soffit or lintel 24 of the frame aperture. Abutments 7 are properly secured while clamping or bonding them to the inside of the frame 2. The frames 2 are then fitted into frame aperture 1 and are aligned, during which operation, the clamping bodies 6 or their sidewalls 4, 5' with the clamping wedge 4, are positioned therebetween and are received by abutments 7 or their U-legs 8. After the alignment of frames 2, the set screws 3 are actuated so that clamping wedges 4 initially apply at a point B against sidewall 5 and then, due to their tilting motion, at a point C against the sidewalls 5' of clamping body 6. By further actuating one of more set screws 3, the sidewalls 5 and 5' of clamping body 6 are spread apart and pressed against respective ones of the walls 8 and 8' of abutment 7, so that finally a secure hold and a quite satisfactory clamping effect are obtained.

While a specific embodiment of the invention has been shown and described in detail to illustrate the application of the principles of the invention, it will be understood that the invention may be embodied otherwise departing from such principles.

What is claimed is:

1. A clamping device for clamping a structure, such as a door or window case, into a frame of a substantially U-shaped cross-section which has an inner web wall with an offset portion and a sidewall on each side of the web wall, comprising, a clamping body of substantially U-shaped cross-section having a back web wall adapted to be secured to the structure and a leg wall on each side of said web wall extending outwardly therefrom having at least a portion of its length which is resilient, a substantially U-shaped abutment having a back abutment wall adapted to be engaged in the offset portion of the frame and having an abutment side wall on each side of the back abutment wall disposed alongside and exteriorly of respective ones of said leg walls, a clamp member movably disposed in said clamping body between said side leg walls thereof and being diplaceable to deflect said side leg walls into clamping engagement with said abutment sidewalls, and set screw means threadable in the frame and threadedly engageable with said clamp member to shift said clamp member to deflect it to engage said side leg walls with said abutment sidewalls and to clamp the structure in the frame, said clamping member comprising a member having a uniformly dimensioned portion disposed between said side leg walls and a wedge-shape portion extending beyond said side leg walls and between said abutment sidewalls which threadedly receives said set screw.

2. A clamping device for clamping a structure, as claimed in claim 1, wherein said wedge-shape portion of said clamp member has a tapered threaded hole receiving said set screw.

3. A clamping device for clamping a structure, as claimed in claim 1, wherein said side leg walls of said clamping body are separated from said back web wall along a portion of the length thereof so as to make these portions resilient.

4. A clamping device for clamping a structure, according to claim 1, wherein said clamping body back web wall includes a slot defined along a portion of the length thereof extending inwardly from each end alongside respective ones of said side leg walls so as to make these leg wall portions resilient.

* * * * *